US006312268B1

(12) United States Patent
Chih-Kai

(10) Patent No.: US 6,312,268 B1
(45) Date of Patent: Nov. 6, 2001

(54) ELECTRIC CONNECTOR WITH A POSITIONING TERMINAL

(75) Inventor: Chang Chih-Kai, Sanchung (TW)

(73) Assignee: Tekcon Electronics Corp., Taipei (TW)

( * ) Notice: Subject to any disclaimer, the term of this patent is extended or adjusted under 35 U.S.C. 154(b) by 0 days.

(21) Appl. No.: 09/459,350

(22) Filed: Dec. 13, 1999

(51) Int. Cl.[7] ..... H01R 13/652
(52) U.S. Cl. ..... 439/108; 439/80; 439/748
(58) Field of Search ..... 439/79, 80, 101, 439/108, 608, 908, 746, 748

(56) References Cited

U.S. PATENT DOCUMENTS 3,732,531 * 5/1973 Bouley ..... 439/908
3,783,440 * 1/1974 Karube et al. ..... 439/748
5,238,414 * 8/1993 Yaegashi et al. ..... 439/108
5,304,069 * 4/1994 Brunker et al. ..... 439/108
5,413,491 * 5/1995 Noschese ..... 439/108

* cited by examiner

*Primary Examiner*—Hien Vu

(57) ABSTRACT

An electric connector includes a dielectric connector body (1), an insulative partition frame (2), a plurality of signal terminals (4) received in the connector body and the partition frame, a conductive positioning terminal (3) located in the connector body and the partition frame, a metal shell (5) positioned to the connector body, and a pair of plug elements (6) and rivet elements (7) cooperative to secure the partition frame to the connector body. The positioning terminal comprises a first flat coupling wall (31) and a second flat coupling wall (32) which defines a locating notch (322) at a bottom edge thereof. A locating block (213) raise from the partition frame into the locating notch, thereby fixing the positioning terminal in position.

6 Claims, 9 Drawing Sheets

ELECTRIC CONNECTOR WITH A POSITIONING TERMINAL

BACKGROUND OF THE INVENTION

The present invention relates to an electric connector, and more particularly to such an electric connector, which comprises a connector body and a partition frame fastened together to hold a set of signal terminals, and an angled positioning terminal coupled between the connector body and the partition frame to secure the connector body and the partition frame in position. The positioning terminal comprises hooked retaining arms respectively hooked in a locating hole at the connector body, two mounting legs respectively inserted through respective locating holes at the partition frame, and a locating notch engaged with a locating block at the partition frame.

FIG. 6 shows an electric connector with angled terminals according to Taiwan Patent Publication No. 308375. This structure of electric connector comprises a connector body holding a set of terminals, a metal shell covered on the connector body at the front side, a partition frame fastened to the connector body at the back side to support the terminals, a fastening device fastened to the connector body and the partition frame for grounding. The fastening device secures the connector body and the partition frame together. This structure of electric connector is still not satisfactory in function. Because the fastening device has a complicated structure, its manufacturing cost is high. Further, the coupling structure between the fastening device and the partition frame is complicated. It takes much time to fasten the fastening device to the partition frame and the connector body.

SUMMARY OF THE INVENTION

The present invention has been accomplished to provide an electric connector, which eliminates the aforesaid drawbacks. According to one aspect of the present invention, the electric connector comprises a connector body having rows of terminal slots and a locating slot, a partition frame coupled to the connector body, a set of signal terminals respectively mounted in the terminal slots at the connector body and respective insertion slots at the partition frame, and a positioning terminal fastened to the locating slot at the connector body to hold down the partition frame, wherein the locating slot of said connector body comprises a sloping guide wall portion at a rear end thereof and a retaining wall portion at a front end thereof; the positioning terminal comprises a first flat coupling wall and a second flat coupling wall connected at right angles, two sloping edges respectively provided at top and bottom sides of the first flat coupling wall and stopped at the sloping guide wall portion in the locating slot at the connector body, two springy retaining arms forwardly extended from the sloping edges at the first flat coupling wall and inserted into the locating slot at the connector body, the retaining arms each having a hooked portion respectively hooked on the retaining wall portion in the locating slot at the connector body, and two elongated clamping strips forwardly extended from the first flat coupling wall between the retaining arms. By using a tool to squeeze the hooked portions of the retaining arms toward each other, the positioning terminal can easily be disconnected from the locating hole at the connector body. According to another aspect of the present invention, the partition frame comprises two locating holes and a locating block disposed between the locating holes, the positioning terminal comprises two mounting legs downwardly extended from the second flat coupling wall thereof and respectively mounted in the locating holes at the partition frame, and a locating notch disposed at the bottom side of the second flat coupling wall and forced into engagement with the locating block at the partition frame.

DETAILED DESCRIPTION OF THE PREFERRED EMBODIMENT

Figure 1:
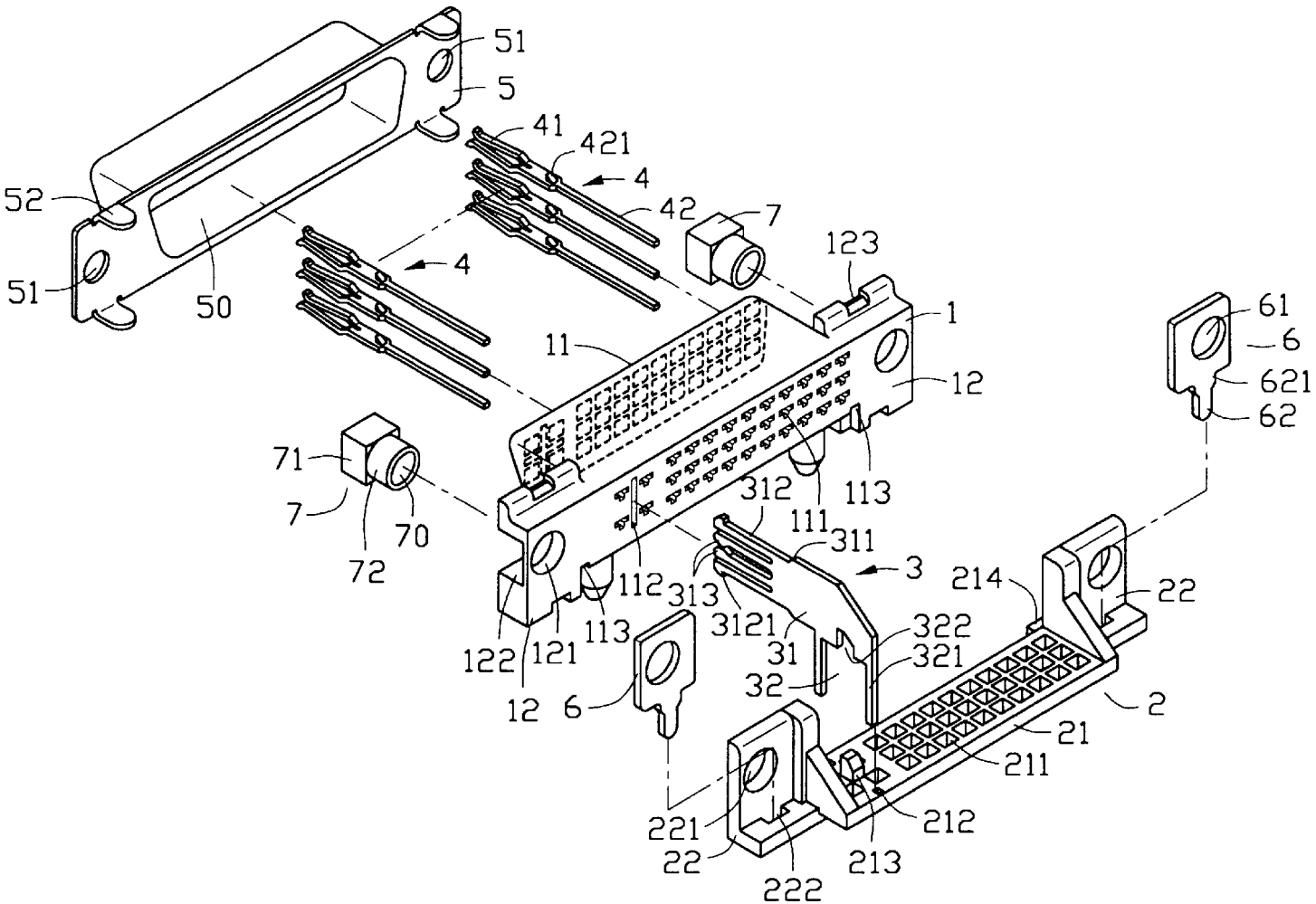
FIG. 1 is an exploded view of an electric connector according to the present invention.
Figure 2:
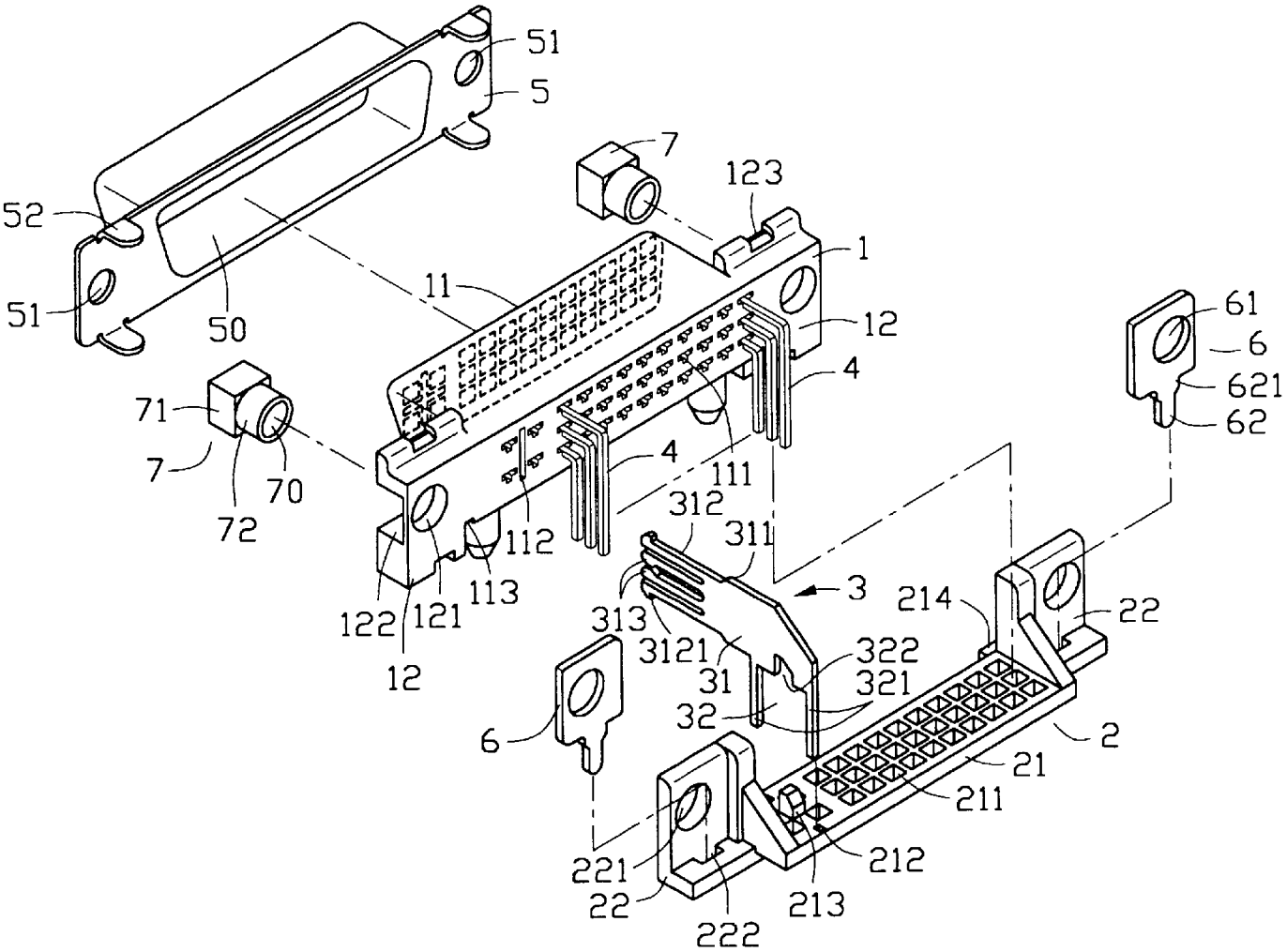
FIG. 2 is similar to FIG. 1 but showing the signal terminals installed in the terminal slots at the base of the connector body.
Figure 3:
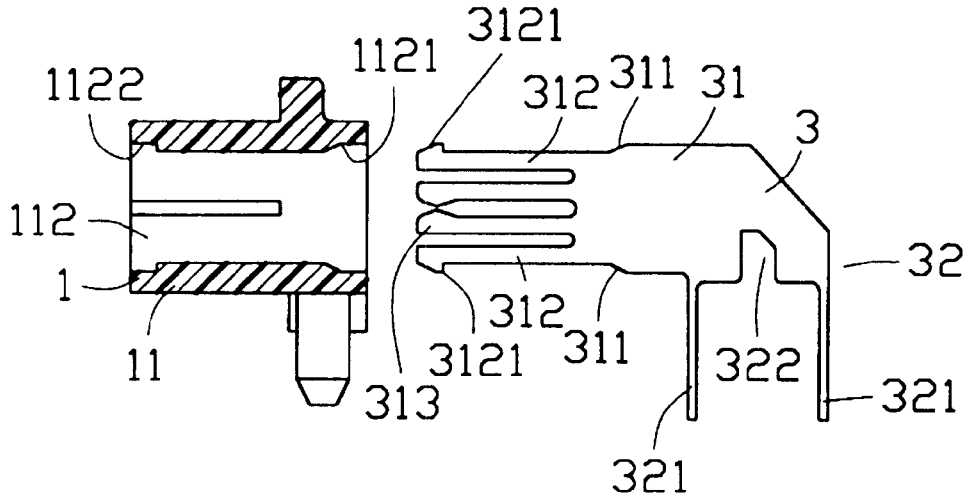
FIG. 3 is a sectional view of a part of the present invention, showing the relationship between the connector body and the positioning terminal.
Figure 3A:
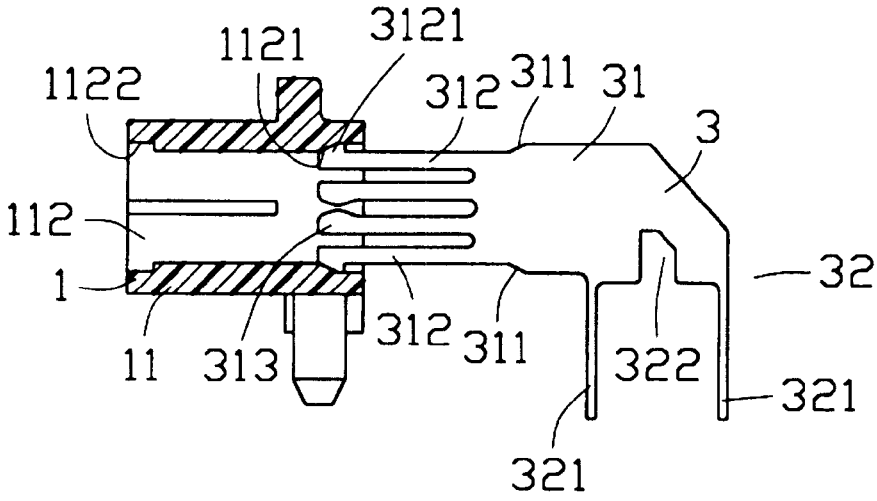
FIG. 3A is similar to FIG. 3 but showing the retaining arms of the positioning terminal inserted into the rear end of the locating slot at the base of the connector body.
Figure 3B:
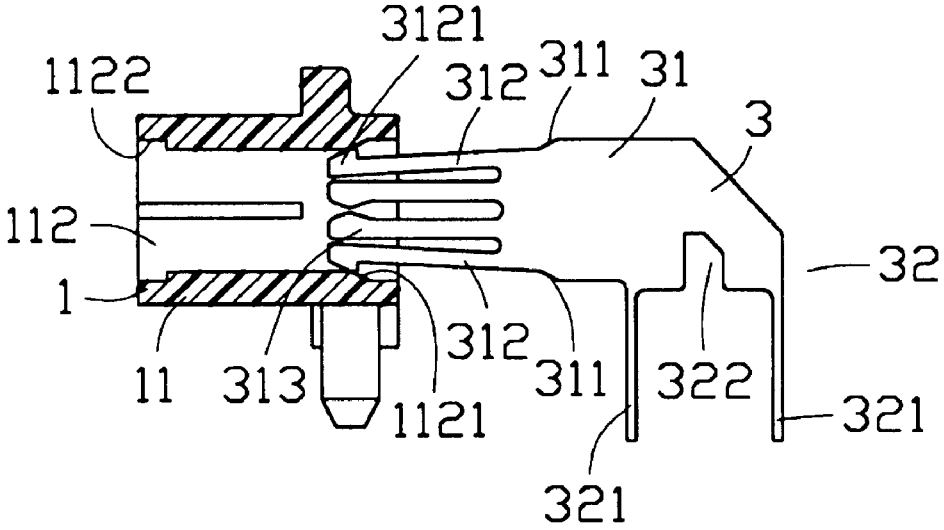
FIG. 3B is similar to FIG. 3A but showing the retaining arms of the positioning terminal forced inwards by the sloping guide wall portion.
Figure 3C:
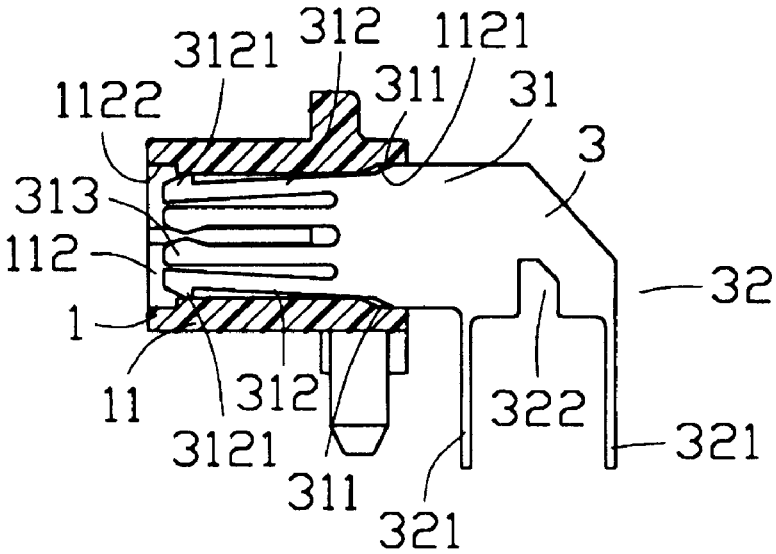
FIG. 3C is similar to FIG. 3B but showing the sloping edges of the positioning terminal moved to the sloping guide wall portion in the locating slot at the base of the connector body.
Figure 3D:
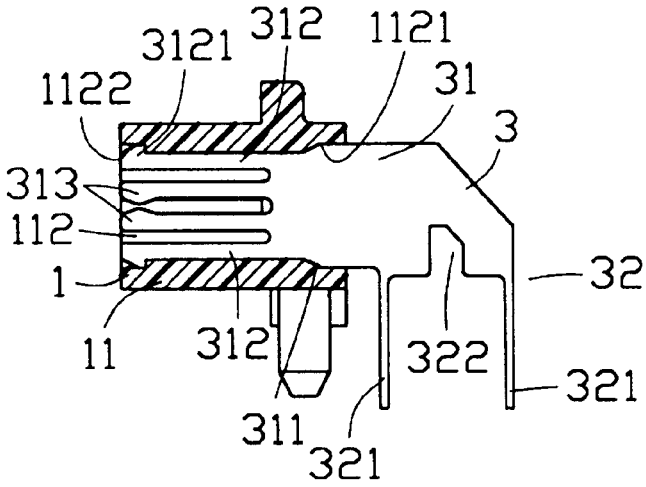
FIG. 3D is similar to FIG. 3C but showing the hooked portion of each retaining arm hooked on the retaining wall portion in the locating slot at the base of the connector body.
Figure 3E:
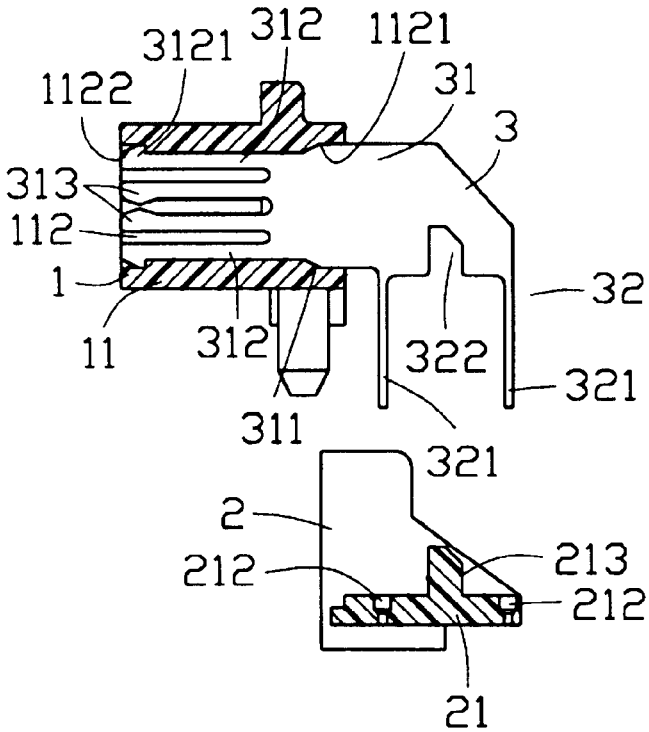
FIG. 3E is a sectional view of a part of the present invention, showing the relationship between the positioning terminal at the connector body and the partition frame.
Figure 3F:
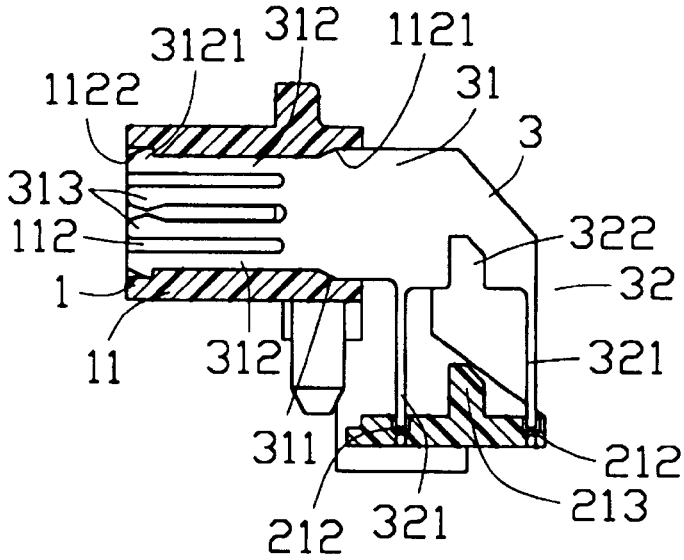
FIG. 3F is similar to FIG. 3E but showing the mounting legs of the positioning terminal inserted into the locating holes at the partition frame.
Figure 3G:
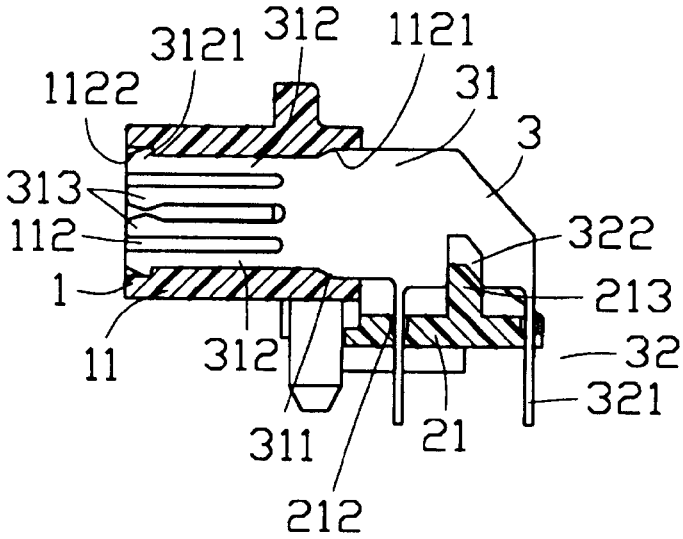
FIG. 3G is similar to FIG. 3F but showing the mounting legs of the positioning terminal passed through the locating holes at the partition frame, the locating block at the partition frame partially engaged into the locating notch at the positioning terminal.
Figure 3H:
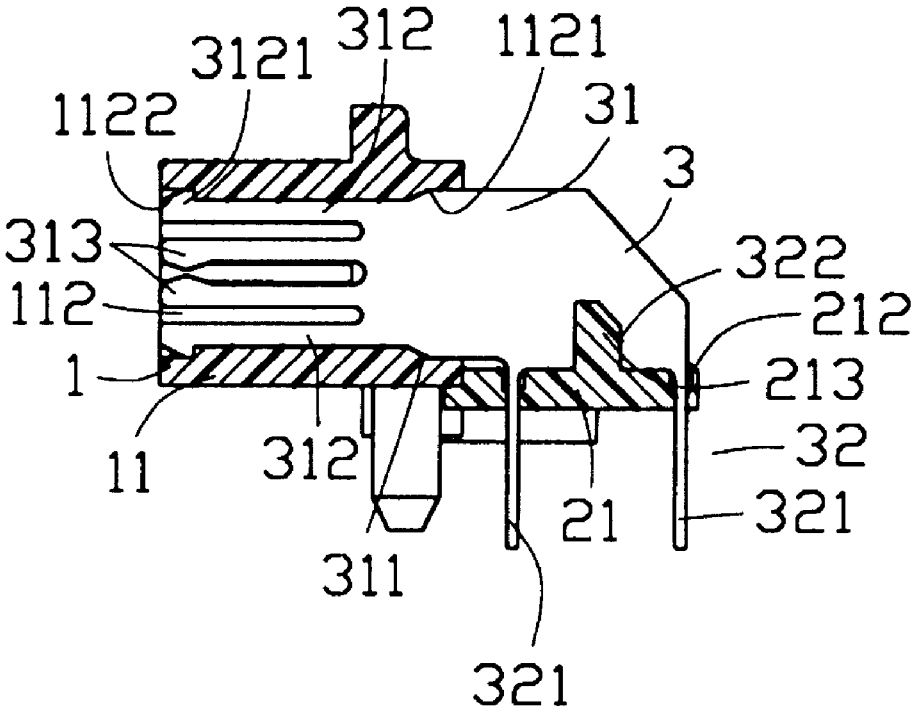
FIG. 3H is similar to FIG. 3G but showing the locating block at the partition frame engaged with the locating notch at the positioning terminal.
Figure 4:
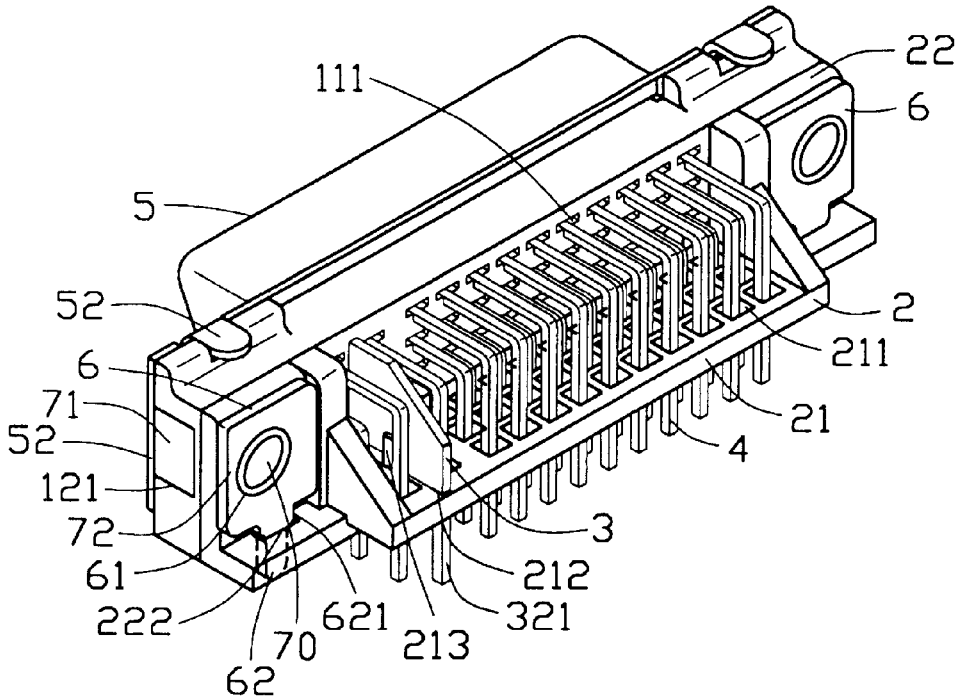
FIG. 4 is an elevational view of the present invention, showing the electric connector assembled.
Figure 5:
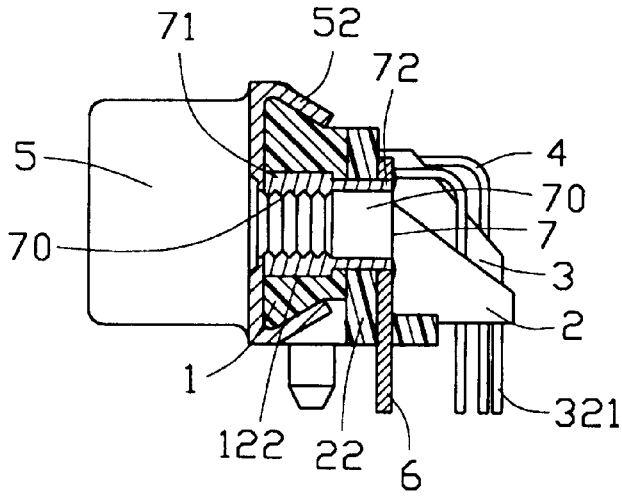
FIG. 5 is a side view in section of the present invention, showing the electric connector assembled.
Figure 6:
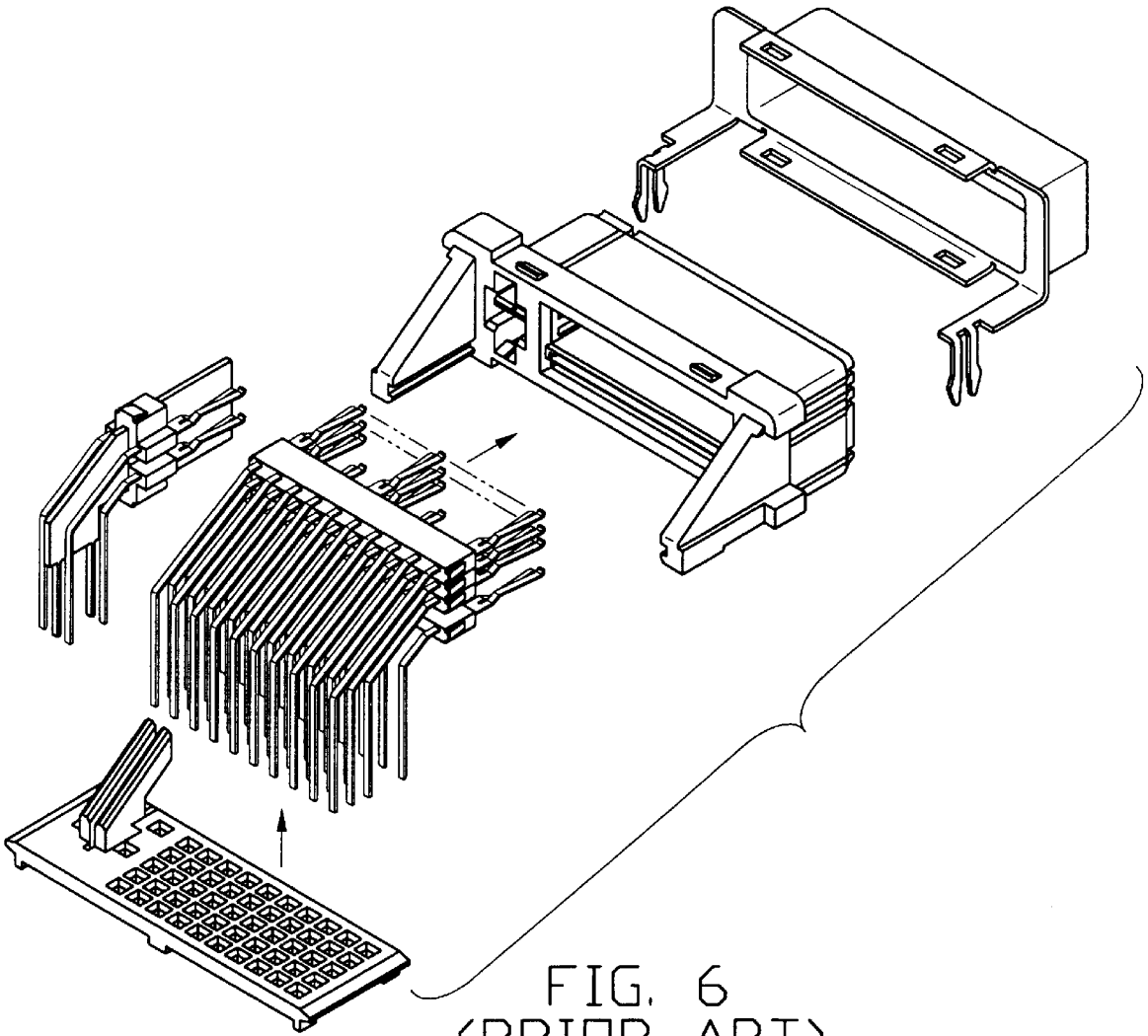
FIG. 6 (PRIOR ART)
FIG. 6 is an exploded view of an electric connector according to the prior art.

Referring to FIGS. 1, 2 and 3, an electrical connector is shown comprised of a connector body 1, a partition frame 2, a positioning terminal 3, a set of signal terminals 4, a metal shell 5, two plug elements 6, and two rivet elements 7.

The connector body 1 is an electrically insulative member comprising a substantially rectangular base 11, and two mounting blocks 12 symmetrically formed integral with two opposite lateral side walls of the base 11 and disposed in flush with the back side wall of the base 11. The base 11 comprises rows of terminal slots 111 and an elongated locating slot 112 through front and backside walls thereof, and two bottom notches 113 bilaterally provided at a bottom sidewall thereof. The locating slot 112 has a sloping guide wall portion 1121 at a rear end thereof for guiding the positioning terminal 3 into position, and a retaining wall portion 1122 at a front end thereof for engagement with the positioning terminal 3 (see FIG. 3). The mounting blocks 12 each comprise a substantially rectangular positioning recess 122, a through hole 121 through the positioning recess 122, and two locating notches 123 at the top and bottom sides.

The partition frame 2 is a substantially U-shaped frame comprising a flat board 21, and two substantially L-shaped mounting plates 22 formed integrally with two distal ends of the flat board 21. The flat board 21 comprises rows of insertion slots 211 corresponding to the terminal slots 111 at the connector body 1, two locating holes 212 disposed near one mounting plate 22, a locating bock 213 raised from a top side wall thereof between the locating holes 212, and two protruding blocks 214 bilaterally extending forwardly from the front edge thereof adjacent to the L-shaped mounting plates 22. The locating block 213 is aligned with the locating holes 212 in a direction transverse to the flat board 21. The L-shaped mounting plates 22 each comprise a through hole 221 at a vertical wall thereof corresponding to the through hole 121 at each mounting block 12 of the connector body 1, and a locating hole 222 at the horizontal wall thereof transverse to the vertical wall.

The positioning terminal 3 is a flat member comprising a first flat coupling wall 31 and a second flat coupling wall 32 connected at an right angle, two sloping edges 311 at top and bottom sides of the first flat coupling wall 31, two retaining arms 312 forwardly extended from the sloping edges 311 at the first flat coupling wall 31 and terminated at hooked portions 3121, two elongated clamping strips 313 forwardly extended from the first flat coupling wall 31 between the retaining arms 312, two mounting legs 321 downwardly extended from the second flat coupling wall 32 corresponding to the two locating holes 212 at the flat board 21 of the partition frame 2, and a locating notch 322 provided at the bottom edge of the second flat coupling wall 32 between the mounting legs 321 corresponding to the locating block 213 at the flat board 21 of the partition frame 2.

The signal terminals 4 are shaped like a tuning fork, each comprising a forked clamping portion 41 at one end, an elongated mounting portion 42 at an opposite end, and a hooked portion 421 on the middle for positioning in one terminal slot 111 at the connector body 1.

The metal shell 5 comprises a receiving chamber 50, which receives the base 11 of the connector body 1, two through holes 51 at two opposite lateral sides corresponding to the through hole 121 at each of the mounting blocks 12 of the connector body 1, and two pairs of mounting lugs 52 respectively disposed adjacent to the through hole 51 corresponding to the locating notches 123 at the mounting blocks 12 of the connector body 1.

The plug elements 6 are flat, each comprising a through hole 61 near a top side thereof, a bottom mounting leg 62, and a shoulder 621 between the through hole 61 and the bottom mounting leg 62 for positioning the plug element 6 in the locating hole 222 at a corresponding mounting plate 22 of the partition frame 2.

The rivet elements 7 each comprise a head 71 at one end for positioning in the positioning recess 122 at one mounting block 12 of the connector body 1, a shank 72 extended from the head 71 for insertion through the through hole 121 at one mounting block 12 of the connector body 1, the through hole 221 at one mounting plate 22 of the partition frame 2 and the through hole 61 at one mounting element 6, and a screw hole 70 through the shank 72 and the head 71.

The assembly process of the present invention is outlined hereinafter with reference to FIGS. 3A through 5. The signal terminals 4 are respectively inserted into the terminal slots 111 at the connector body 1, permitting the forked clamping portion 41 and hooked portion 421 of each signal terminal 4 to be respectively positioned in the terminal slots 111 at the connector body 1, then the elongated mounting portion 42 of each signal terminal 4 is respectively downwardly bent, and then the positioning terminal 3 is inserted into the locating slot 112 at the base 11 of the connector body 1, permitting the hooked portion 3121 of each of the retaining arms 312 to be hooked on the retaining wall portion 1122 in corresponding locating slot 112 and the sloping edge 311 to be stopped at the sloping guide wall portion 1121 in corresponding locating slot 112 (see Figures from 3A through 3D). Thereafter, the partition frame 2 is attached to the connector body 1 to engage the protruding blocks 214 into the bottom notches 113 at the connector body 1, permitting the angled mounting portions 42 of the signal terminals 4 to be respectively inserted through the insertion slots 211 at the flat board 21 of the partition frame 2, the mounting legs 321 of the positioning terminal 3 to be respectively inserted through the locating holes 212 at the flat board 21 of the partition frame 2, and the locating block 213 of the partition frame 2 to be forced into engagement with the locating notch 322 at the positioning terminal 3 (see Figures from 3E through 3H). Then, the flat plug elements 6 are respectively inserted through the locating holes 222 at the mounting plates 22 of the partition frame 2, so that the shoulders 621 are respectively firmly fitted into the locating holes 22 at the mounting plates 22 of the partition frame 2. After installation of the plug elements 6, the rivet elements 7 are installed to secure the connector body 1, the plug elements 6 and the partition frame 2 together by: inserting the shank 72 of one rivet element 7 through the through hole 121 at one mounting block 12 of the connector body 1, the through hole 221 at one mounting plate 22 of the partition frame 2 and the through hole 61 at one plug element 6, for enabling the head 71 of one rivet element 7 to be positioned in the positioning recess 122 at one mounting block 12 of the connector body 1, and then hammered down the end of the shank 72 of each rivet element 7 to form another head (see FIGS. 4 and 5). After installation of the rivet elements 7, the metal shell 5 is covered on the connector body 1 to insert the mounting lugs 52 through the locating notches 123 at the mounting blocks 12 of the connector body 1, and then the mounting lugs 52 are respectively bent inwards and closely attached to the back sidewall of each of the mounting blocks 12 of the connector body 1 (see FIGS. 4 and 5). After installation of the metal shell 5, the base 11 of the connector body 1 is received inside the receiving chamber 50, and the through holes 51 of the metal shell 5 are respectively aligned with the screw holes 70 at the rivet elements 7. Screws (not shown) can then be threaded into respective screw holes 70 to fixedly secure the electric connector to a casing of an apparatus (for example, the mainframe of a computer, or a switch box).

Because the hooked portions 3121 of the retaining arms 312 of the positioning terminal 3 are hooked on the retaining wall portions 1122 in corresponding locating slot 112 and the sloping edges 311 are abutted against the sloping guide wall portions 1121 in corresponding locating slot 112, the positioning terminal 3 is firmly secured to the locating slot 112 in the base 11 of the connector body 1, and prohibited from displacement. When disconnecting the positioning terminal 3 from the connector body 1, a tool is used to force the retaining arms 312 to move inwards, enabling the hooked portion 3121 of each retaining arm 312 to be disengaged from corresponding retaining wall portion 1122.

Further, because the mounting legs 321 of the positioning terminal 3 are respectively inserted through the locating holes 212 at the partition frame 2 and the locating notch 322 of the positioning terminal 3 is engaged with the locating block 213 at the partition frame 2, and because the protruding blocks 214 of the partition frame 2 are respectively engaged into the bottom notches 113 at the connector body 1, the connector body 1, the positioning terminal 3 and the partition frame 2 are firmly retained together against vibration.

As indicated above, when the connector body 1, the partition frame 2 and the plug elements 6 are assembled together, the through hole 121 at each mounting block 12, the through hole 61 at each plug element 6 and the through hole 221 at each L-shaped mounting plate 22 are respectively aligned for quick insertion of the shank 72 of each rivet element 7, enabling the head 71 of each rivet element 7 to be respectively and positively positioned in the rectangular positioning recess 122 at each mounting block 12, so that the connector body 1, the plug elements 6 and the partition frame 2 can be firmly secured together by hammering down the free end of the shank 72 of each rivet element 7 to form a respective head.

As indicated, the metal shell 5 is covered on the connector body 1, enabling the rectangular base 11 of the connector body 1 to be received in the receiving chamber 50, and the mounting lugs 52 to be respectively inserted through the locating notches 123 at the mounting blocks 12 at the connector body 1, and then the mounting lugs 52 are respectively bent inwards and closely attached to the back sidewall of each of the mounting blocks 12 of the connector body 1 (see FIGS. 4 and 5) to secure the metal shell 5 and the connector body 1 firmly together. After installation of the metal shell 5, the through holes 51 of the metal shell 5 are respectively aligned with the screw hole 70 at each rivet element 7 for securing to the casing of an apparatus (for example, the mainframe of a computer, or a switch box) by screw means.

While only one embodiment of the present invention has been shown and described, it will be understood that various modification and changes could be made thereunto without departing from the spirit and scope of the invention disclosed.

What the invention claimed is:

1. An electric connector comprising:

a connector body, said connector body comprising a base having rows of terminals slots and a locating slot, and a set of signal terminals respectively mounted in said terminal slots, said locating slot having a pair of sloping guide wall portions at a rear end thereof and a pair of retaining wall portions at a front end thereof;

a positioning terminal mounted in the locating slot at the base of said connector body, said positioning terminal comprising a first flat coupling wall and a second flat coupling wall connected at right angle, two sloping edges respectively provided at top and bottom sides of said first flat coupling wall and abutted with the sloping guide wall portions in the locating slot at said base of said connector body when said positioning terminal is inserted in said locating slot, two flexible retaining arms forwardly extended from said sloping edges at said first flat coupling wall and being located in the locating slot at the base of said connector body, said retaining arms each having a front end terminating in a hooked portion respectively hooked on the retaining wall portion in the locating slot at the base of said connector body, and two elongated clamping strips forwardly extended from said first flat coupling wall between said retaining arms, said second flat coupling wall having two mounting legs extending downwardly therefrom and a locating notch provided at a bottom edge thereof between said mounting legs; and a partition frame fastened to said connector body, said partition frame comprising a flat board, two locating holes at said flat board which respectively receive the mounting legs of said positioning terminal, and a locating block raised from said flat board between the locating holes and forced into the locating notch at said second flat coupling wall of said portioning terminal.

2. The electric connector of claim 1 wherein said connector body comprises two bottom notches bilaterally provided at the base of connector body at a bottom side, and said partition frame comprises two protruding blocks forwardly extended from said flat board and respectively engaged into the bottom notches at the base of said connector body.

3. The electric connector of claim 2 wherein said partition frame comprises two substantially L-shaped mounting plates formed integrally with two distal ends of said flat board, said L-shaped mounting plates each having a through hole, and two plug elements respectively mounted in said L-shaped mounting plates, said plug elements each having a through hole respectively aligned with the through hole at corresponding L-shaped mounting plates; said connector body comprises two mounting blocks extended from two opposite lateral sides of said base, said mounting blocks each comprising a through hole respectively aligned to the through hole at corresponding L-shaped mounting plates of said partition frame and the through hole at corresponding plug element for insertion of rivet elements, and two locating notches at top and bottom sides thereof.

4. The electric connector of claim 3 further comprising a metal shell covered on said connector body, said metal shell comprising a receiving chamber, which receives the base of said connector body, and two pairs of mounting lugs respectively fastened to the locating notches at the mounting blocks of said connector body.

5. The electric connector of claim 4 wherein the mounting blocks of said connector body each comprise a positioning recess, the rivet element, which secure the mounting blocks of said connector body to the mounting plates of said partition frame and said plug elements, each comprise a positioning head received in the positioning recess at corresponding mounting block of said connector body.

6. The electric connector of claim 4 wherein said L-shaped mounting plates of said partition frame each comprise a locating hole at a horizontal wall thereof, and said plug elements each comprise a bottom mounting leg at a bottom side respectively inserted through the locating hole at each of said mounting plates of said partition frame, and a shoulder fitted into the locating hole at each of said mounting plates of said partition frame.

* * * * *